US005505563A

United States Patent [19]

Curt

[11] Patent Number: 5,505,563

[45] Date of Patent: Apr. 9, 1996

[54] CELLULAR STRUCTURES FOR SUSTAINING WALLS

[76] Inventor: Valerian Curt, 45, avenue De Bercy, Candiac, Quebec, Canada, J5R 4B8

[21] Appl. No.: 847,994

[22] PCT Filed: Aug. 17, 1990

[86] PCT No.: PCT/CA90/00262

§ 371 Date: Apr. 21, 1992

§ 102(e) Date: Apr. 21, 1992

[87] PCT Pub. No.: WO91/02851

PCT Pub. Date: Mar. 7, 1991

[30] Foreign Application Priority Data

Aug. 21, 1989 [CA] Canada ..... 608914

[51] Int. Cl.[6] ..... E02D 29/02

[52] U.S. Cl. ..... 405/262; 405/284

[58] Field of Search ..... 405/258, 262, 405/272, 284, 285, 286, 287, 287.1

[56] References Cited

U.S. PATENT DOCUMENTS

| | | | |
|---|---|---|---|
| 1,943,800 | 1/1934 | Morrison | 61/39 |
| 3,820,344 | 6/1974 | Caron | 61/35 |
| 4,341,491 | 7/1982 | Neumann | 405/258 |
| 4,530,622 | 7/1985 | Mercer | 405/258 |
| 4,836,718 | 6/1989 | Deaton | 405/262 |
| 4,914,887 | 4/1990 | Meheen | 52/565 |

FOREIGN PATENT DOCUMENTS

| | | |
|---|---|---|
| 1186516 | 8/1985 | Canada . |
| 0215407 | 3/1987 | European Pat. Off. . |
| 339965 | 6/1904 | France . |
| 2406035 | 10/1977 | France . |
| 2233857 | 1/1985 | France . |
| 1922119 | 5/1970 | Germany . |
| 2716250 | 10/1978 | Germany . |
| 3121681 | 2/1982 | Germany . |
| 3402314 | 7/1984 | Germany . |
| 2131063 | 6/1984 | United Kingdom . |

*Primary Examiner*—David H. Corbin
*Attorney, Agent, or Firm*—Swabey Ogilvy Renault

[57] ABSTRACT

A cellular structure for sustaining an embankment is comprised of a vertical facing structure including generally a lattice (1) connected to an embedding structure (2, 3). The embedding structure (2, 3) is extended from the facing structure (1) into the embankment. In a first embodiment, the embedding structure is configured like two lattice sections (2) vertically mounted at the vertical edges of the facing structure (1) and prolonged generally in parallel to the embankment. The embedding structure may also be comprised of at least one U-shaped stirrup (3) connected at each of its free ends to a respective vertical edge of the facing structure (1). In this case, the stirrup (3) is generally extended horizontally in the embankment. The masonry of the facing structure (1) may be carried out in different ways in order to achieve various finishings. The cellular structure may also include a sunk framework (5) between the embankment and the facing structure (1). The cellular structure may thus be filled with stones of smaller or larger dimensions as well as with earth. The use of a geotextile allows the vegetation to grow through the facing structure (1).

35 Claims, 15 Drawing Sheets

CELLULAR STRUCTURES FOR SUSTAINING WALLS

TECHNICAL FIELD

The present invention relates to new cellular structures for producing sustaining walls.

BACKGROUND ART

In my Canadian Patent 1,186,516, I disclose a cellular structure which comprises two straight embedding walls joined by a curved wall which forms the front of the cellular structure. In this type of module, the lateral pressure of the mass retained between the walls of the cellular structure maintains these walls stationary. Indeed, the lateral pressure exerted by the retained mass anchors the walls which retain this mass.

DISCLOSURE OF INVENTION

It is an aim of the present invention to provide new cellular structures for sustaining walls which use materials available on the market.

It is also an aim of the present invention to provide a cellular structure which is of great simplicity as much at the level of the manufacture of the structural elements which constitute the cellular structure as at the level of the carrying into effect thereof.

It is a further aim of the present invention to provide an economical cellular structure.

It is a still further aim of the present invention to provide a cellular structure for which the masonry of the face thereof may be carried out with different finishes.

According to the preceding aims, an advantageous embodiment of the invention includes a cellular structure for sustaining an embankment which comprises a substantially vertical facing structure and a pair of substantially vertical embedding structures made of lattices. Each embedding structure is adapted to be mounted to a respective vertical edge of the facing structure. The facing structure is adapted to define a façade of the cellular structure. The embedding structures are adapted to extend in the embankment.

Another advantageous embodiment of the invention includes a cellular structure for sustaining an embankment which comprises a substantially vertical facing structure and an embedding structure formed at least of one stirrup. The stirrup is adapted for connecting each of its two extremities to a respective vertical edge of the facing structure. The stirrup forms a U-shaped structure adapted to extend in a substantially horizontal way in the embankment. The facing structure is adapted to define a façade of the cellular structure.

Another advantageous embodiment of the invention includes a rigid cellular structure for sustaining an embankment which comprises at least one concrete foundation element and one facing element made of prefabricated concrete adapted to be fixed in a substantially vertical way to the foundation element with first connection means. A pair of embedding elements made of prefabricated concrete are adapted to be fixed in a substantially vertical way to the foundation element with second connection means.

MODES FOR CARRYING OUT THE INVENTION

According to one aspect of the present invention, cellular structures for sustaining walls comprise base structural elements which are made of metallic or synthetic lattices. The lattice can be combined with elements made of metal sheet, with cables or with prefabricated concrete. The juxtaposition and the filling of these cellular structures form sustaining walls.

Figure 1:
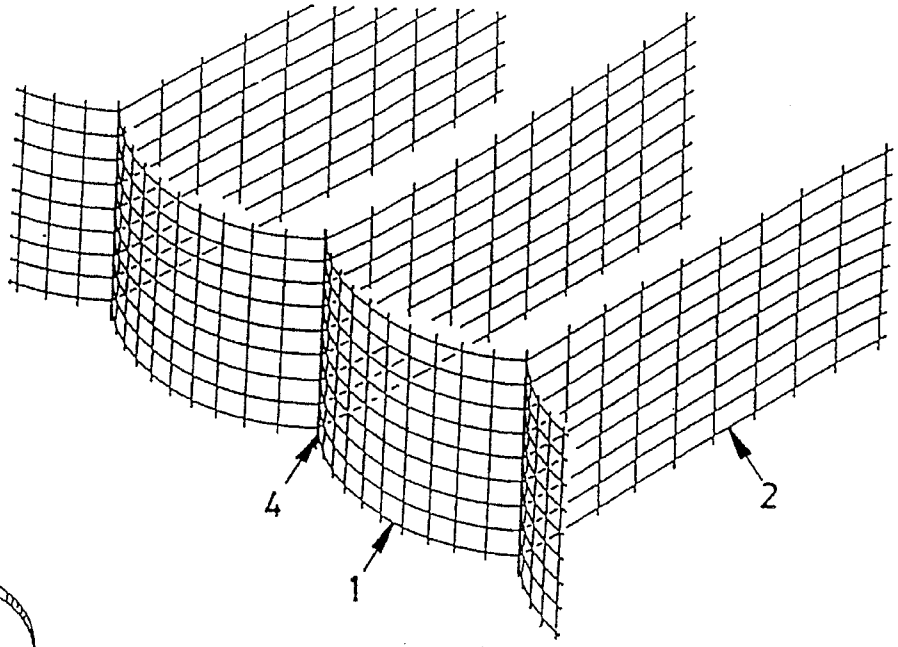
FIG. 1 is a perspective view illustrating a series of cellular structures in accordance with a first embodiment of the present invention, wherein the facing and embedding structures are made of lattices.
Figure 2:
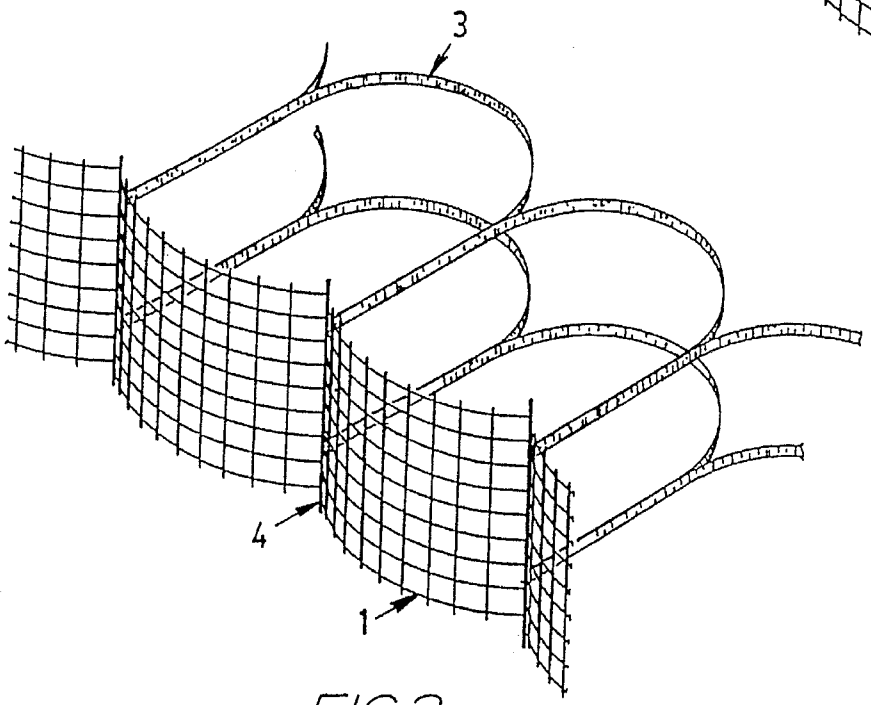
FIG. 2 is a perspective view illustrating a second series of cellular structures in accordance with a second embodiment of the present invention, wherein the facing structures are lattices and the embedding structures are stirrups.

The two basic elements of a cellular structure are the facing elements and the embedding elements. With reference more particularly to FIGS. 1 and 2, the cells in the form of a U are open towards the massif with facing elements 1 and embedding elements 2 being both made of lattices. We can also realize cells which are fictitiously closed, being constituted of facing elements 1 made of lattices and embedding elements 3 made of stirrups (FIG. 2).

As it will be described in detail hereinbelow, the facing elements can be constituted of independent metallic bars or flat bars or even of cables. All of these facing elements can be combined with elements made of prefabricated concrete. Also, cells with facing elements made of blocks of architectural concrete of small or large dimensions can be produced.

In the actual state of knowledge, these types of constructions can be defined as composite and monolithic massifs which are produced by the interdependence between a soil massif and a structure.

All of the metallic elements forming the cellular structure are protected adequately against corrosion. The assembly of the facing elements 1 to the embedding elements 2 or 3 is done by way of rods, circular bars or pipes 4.

The structure illustrated in FIG. 1 is executed by the continuous juxtaposition of cells made of lattice panels or of independent facing and embedding lattice elements 1 or 2. In the latter case, the independent elements are assembled with the rods 4.

The structure of FIG. 2 which comprises facing elements formed of lattices and embedding elements formed of stirrups is assembled with the rods 4.

Figure 3:
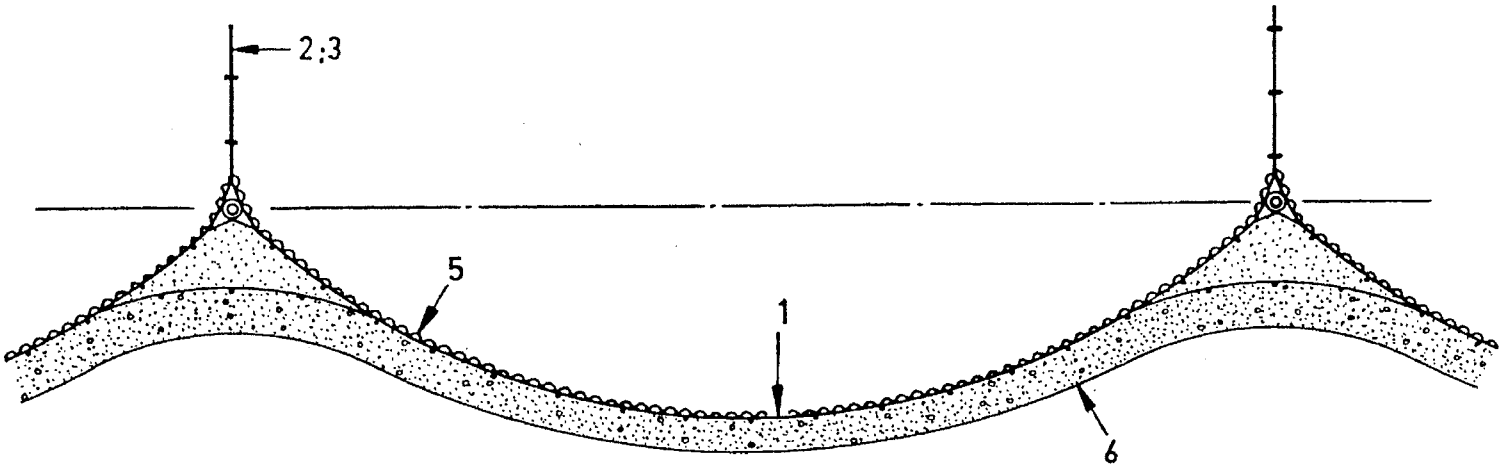
FIG. 3 is a top plan view illustrating the filling of the cellular structures of FIGS. 1 and 2 by way of a sunk framework, and also illustrating a façade of cast concrete.

The structures described hereinabove can be filled with a stone packing. In the case of unavailability of the stone packing, the use of soil is possible with the interposition of a membrane between the embankment and the lattice facing element 1. As illustrated in FIG. 3, this membrane which is like a sunk framework 5 can be made from sheet metal, of plastic or of asbestos-cement. A thick geotextile can also be used.

When the composite work is erected, the second phase consists of completing the work aesthetic-wise. With reference to FIG. 3, this façade revetment is represented by the application of cast concrete 6. This revetment can have aesthetic or resistance purposes.

Figure 4:
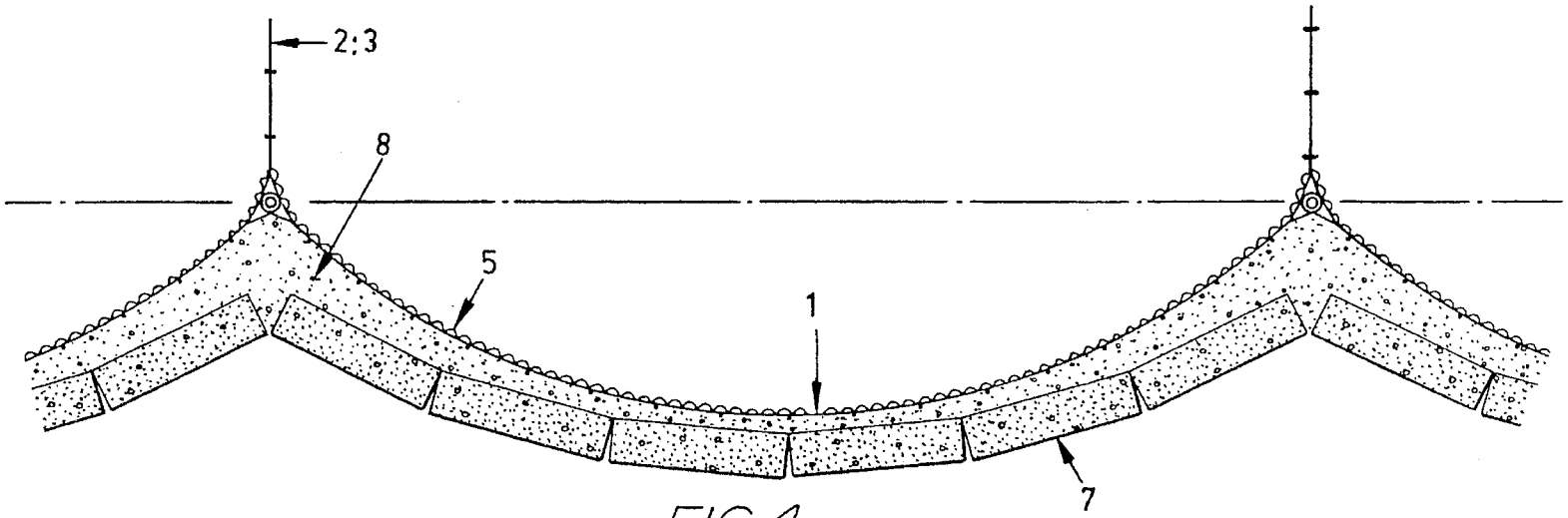
FIG. 4 is a top plan view similar to FIG. 3, but wherein the façade is a masonry made of concrete blocks.

In FIG. 4, the façade revetment is constituted by a masonry made of architectural concrete blocks or of cut stone 7. These concrete blocks can be those used for building façades or they can be adapted specially for sustaining walls. The masonry is fortified with metal rods and tied to the facing structure 1. As an option, the space between the façade masonry 7 and the cellular structure can be filled with concrete 8.

Figure 5:
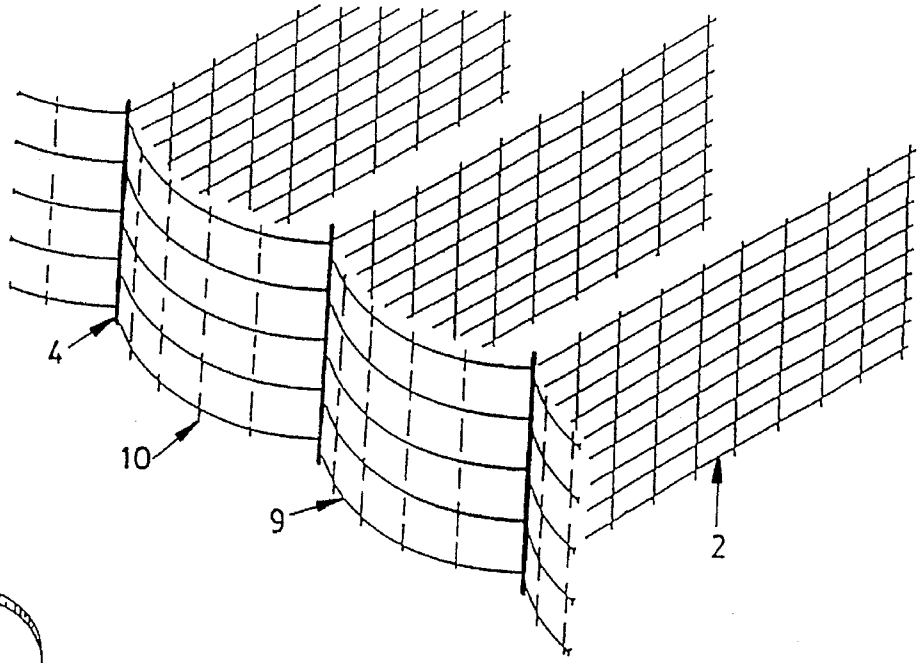
FIG. 5 is a perspective view similar to FIG. 1, but wherein the facing structure is constituted of independent bars.
Figure 6:
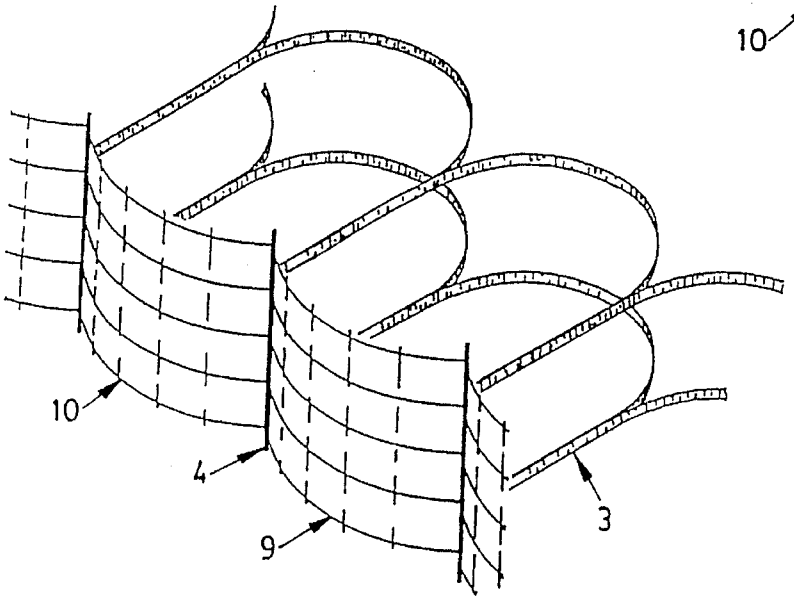
FIG. 6 is a perspective view similar to FIG. 2, but wherein the facing structure is constituted of independent bars for receiving architectural concrete blocks.

It is also possible to integrate the revetment elements to the facing elements 1. The cellular structures so used are similar to those described hereinabove and are represented generally in FIGS. 1 and 2. However, the structure will be realized with a facing structure constituted of independent horizontal and vertical bars or flat bars 9 and 10, as illustrated in FIGS. 5 and 6. The positioning of these independent bars or flat bars 9 and 10 is carried out at the same time as the positioning of the concrete blocks and of the advance of the embankment. The vertical bars 10 are added during execution in the form of joggles.

Figures 7, 7A:
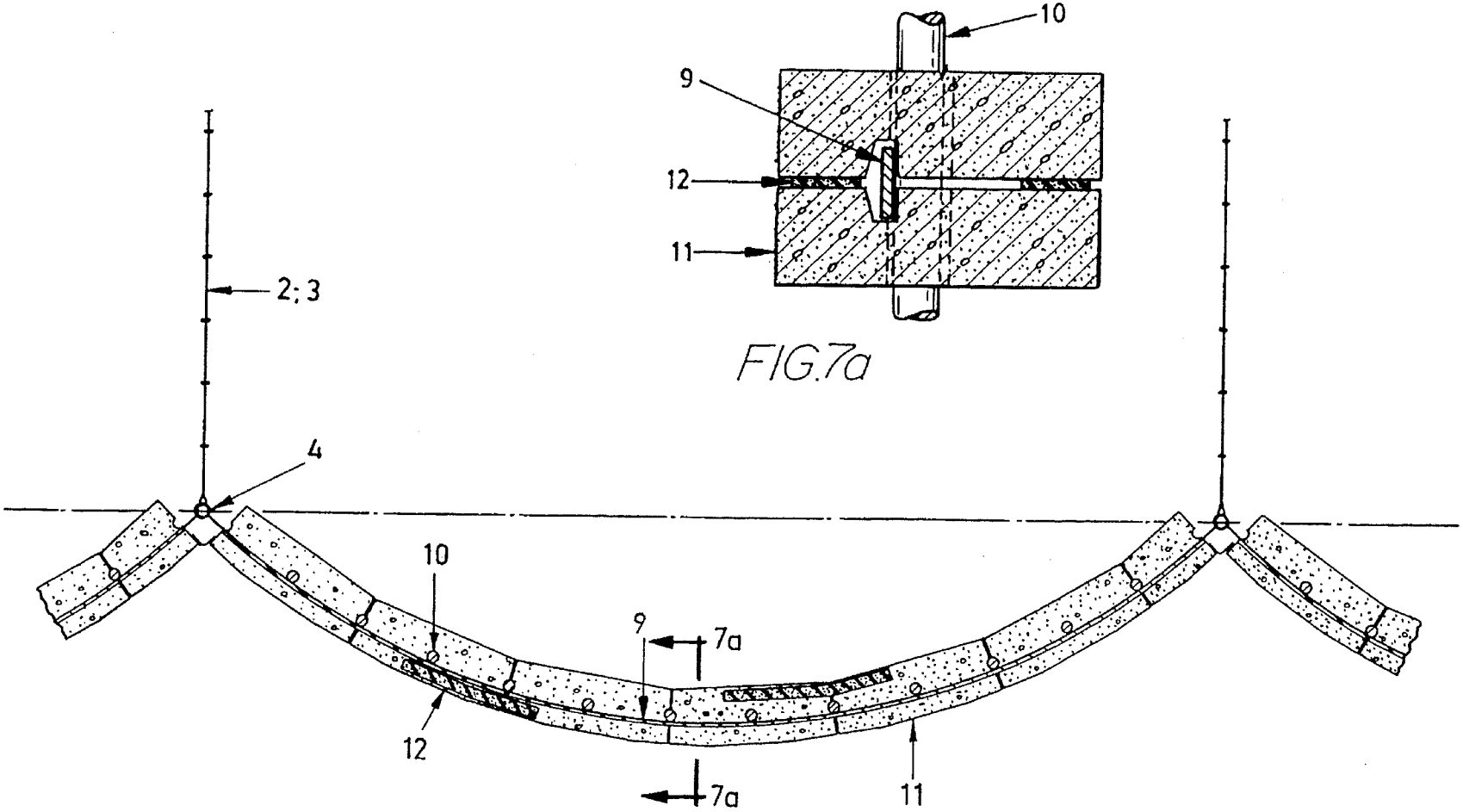
FIG. 7 is a horizontal cross-section illustrating the structures described in FIGS. 5 and 6 and adapted with a façade made of concrete blocks.
FIG. 7*a* is a cross-section taken along lines 7*a*—7*a* of FIG. 7 and illustrating an assembly of the concrete blocks to the facing structure.

During the execution of the work, this type of structure allows for the insertion in the facing structure of small elements made of prefabricated concrete. The concrete blocks for the facing structure are designed for these means and the erection of the facing elements is carried out according to the principles of dry masonry (FIG. 7).

The horizontal facing armature 9 can be realized with metallic circular bars or flat bars. FIG. 7 and 7*a* illustrate the use of metallic flat bars. The vertical armature 10 can be realized with circular bars or with pipes. The prefabricated concrete blocks 11 are adapted for these means. The facing structures produced can thus have the desired aesthetic.

As an option, Neoprene type joints 12 can be used when the cellular structure is subject to important stresses.

Figure 8:
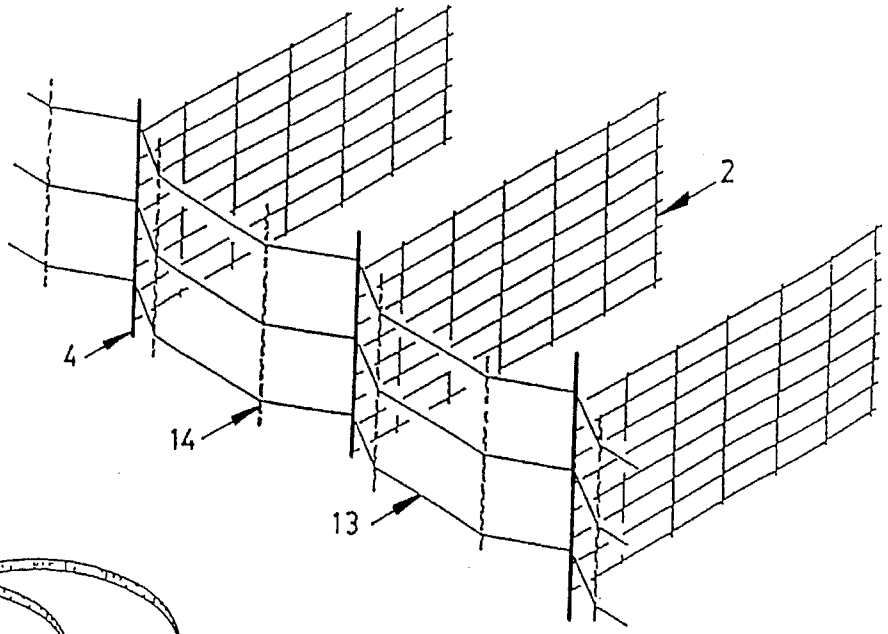
FIG. 8 is a perspective view similar to FIG. 1, but wherein the facing structure is conceived to receive panels made of prefabricated concrete.
Figure 9:
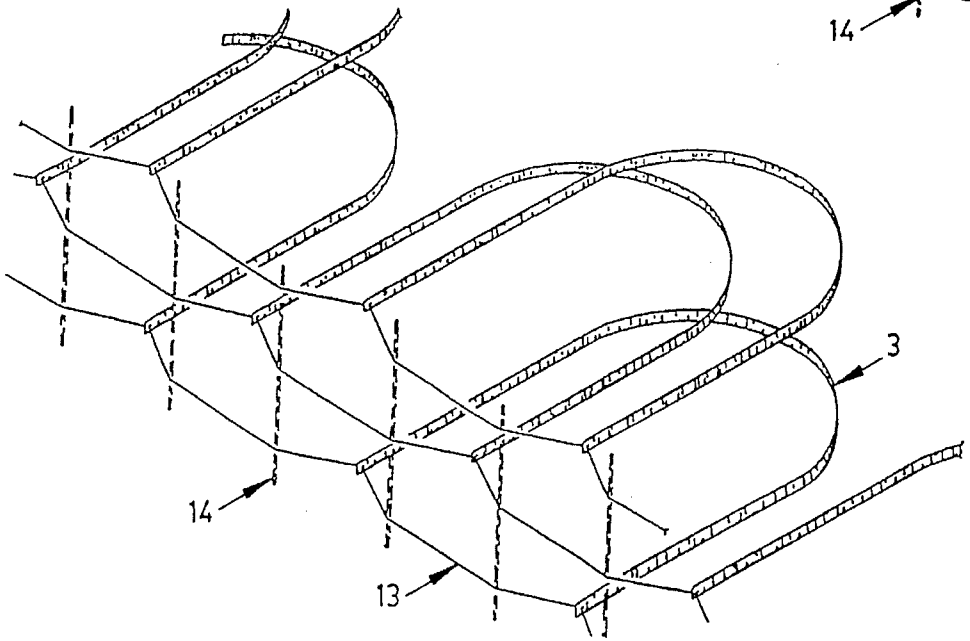
FIG. 9 is a perspective view similar to FIG. 2, but wherein the facing structure is conceived for receiving panels made of prefabricated concrete.

FIGS. 8 and 9 illustrate cellular structures of the same type as those described respectively in FIGS. 1 and 2 but wherein the facing structure is designed for receiving plane panels of large dimensions. The horizontal bars of the facing structure 13 define a broken geometry which is developed from one assembly rod 4 to the other. The changes in the direction of the horizontal bars 13 is done at the level of the vertical bars 14. Cables can replace the horizontal bars 13.

Figure 10:
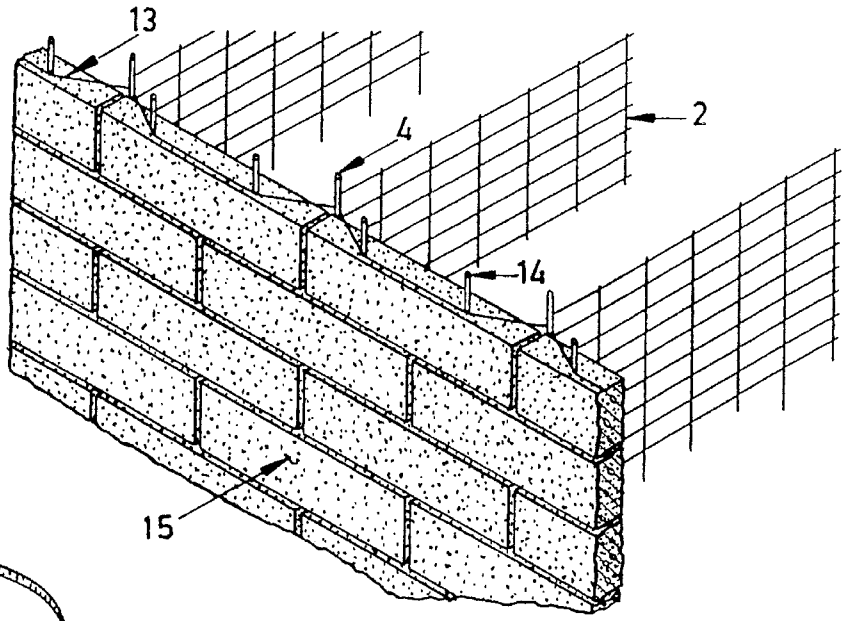
FIG. 10 is a perspective view illustrating a façade made of concrete panels and adapted to the cellular structure of FIG. 8.
Figure 11:
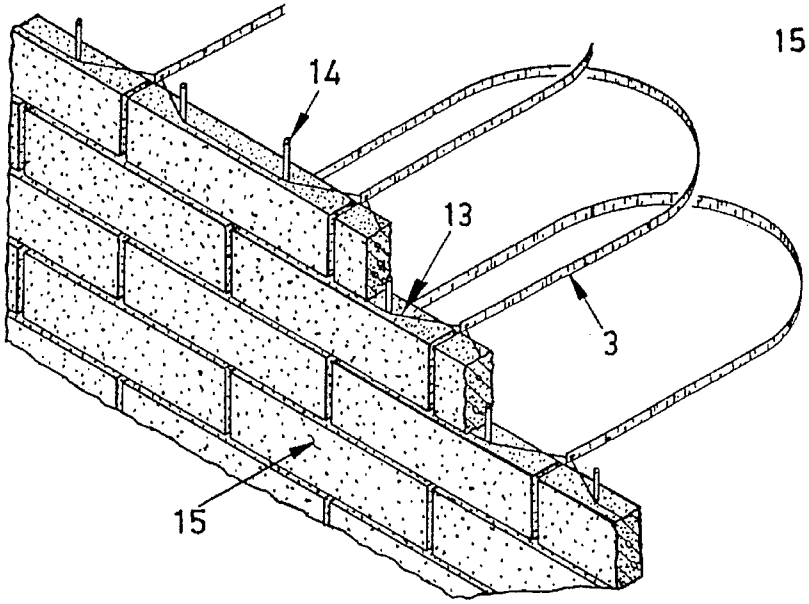
FIG. 11 is a perspective view illustrating a façade made of concrete panels and adapted to the cellular structure of FIG. 9.

FIGS. 10 and 11 illustrate the cellular structures described in FIGS. 8 and 9 which comprise in addition large dimension prefabricated concrete panels 15 which have been inserted in the façade. The prefabricated concrete panels 15 are characterized by the fact that two of their dimensions (width and height) are large with respect to the third dimension (depth). These panels 15 are adapted for resisting to the thrust of the ground. The panels 15 are also designed in order that they can be assembled with the lattice or stirrup embedding structures 2 or 3.

The characteristic of this type of composite structure lies in the fact that a plane facing structure is obtained while preserving the principle of cells which are open or fictitiously closed towards the massif to sustain.

Figures 12, 12A:
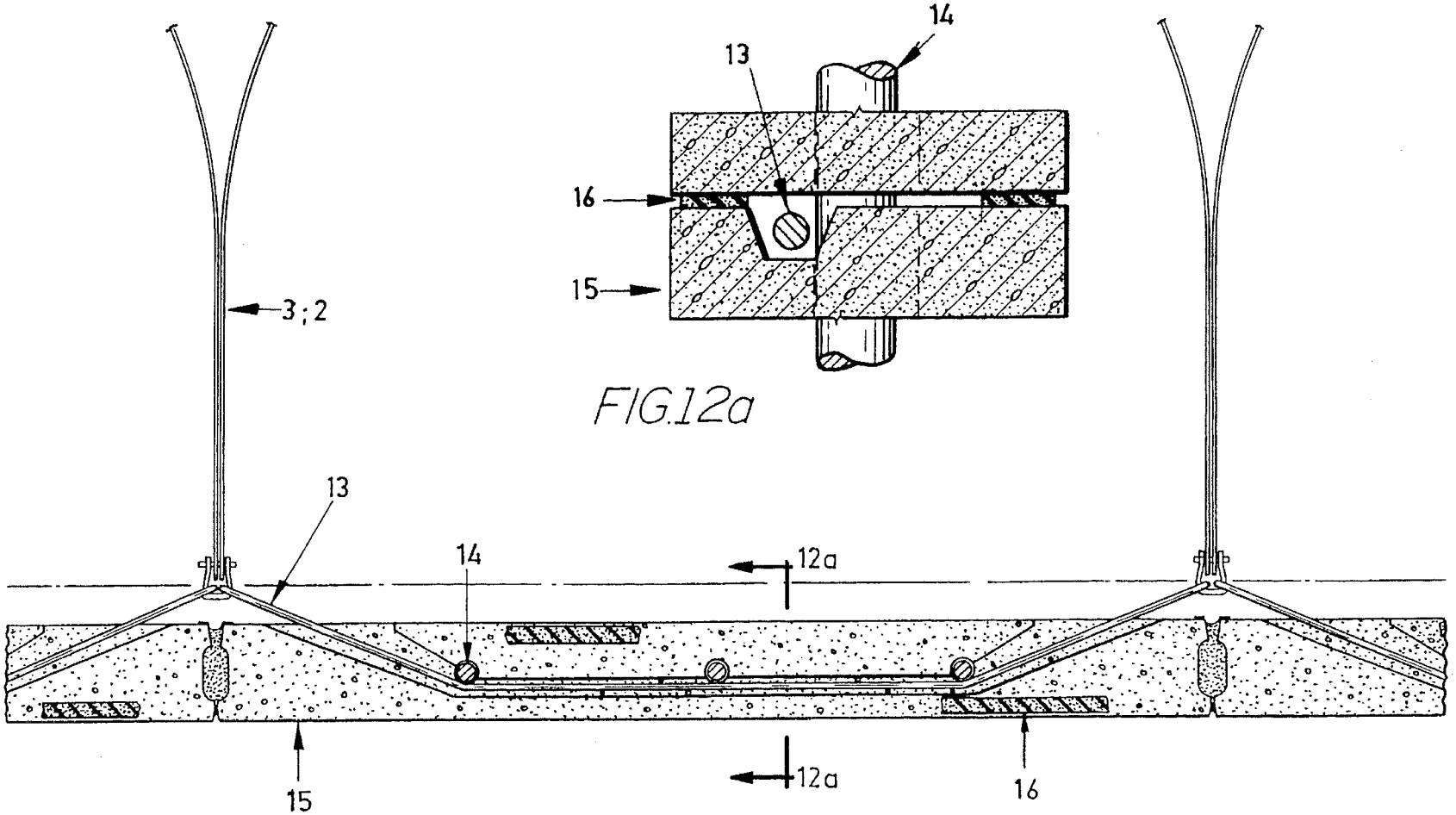
FIG. 12 is a horizontal cross-section of the structures described in FIGS. 10 and 11.
FIG. 12*a* is a cross-section taken along lines 12*a*—12*a* of FIG. 12.

FIG. 12 illustrates the details of the structures described in FIGS. 8 to 11. The horizontal armatures of the facing structure are cylindrical bars or cables 13. The vertical bars 14 are pipes which are perforated or not. Neoprene type strips 16 are intended for the horizontal joints (FIG. 12*a*).

This type of structure is thus carried out dry with Neoprene joints and as assembly joggles, pipes which are perforated or not are used.

The use of joggles-pipes allows for the retransmission of the stresses of the cables to the joggles and from the joggles to the concrete on surfaces which are larger.

The perforated joggles-pipes allow, after the work has been carried out, for injections to be made with a view of realizing the monolithism of the facing structure.

The joggles-pipes allow also for the realization of the post-tension of the façade if desired. Also, cables positioned in the pipes can extend to the foundation in order to be thereafter post-tensioned.

In this way, very large resistance sustaining walls can be realized, especially at the level of the dynamic stresses.

Figure 13:
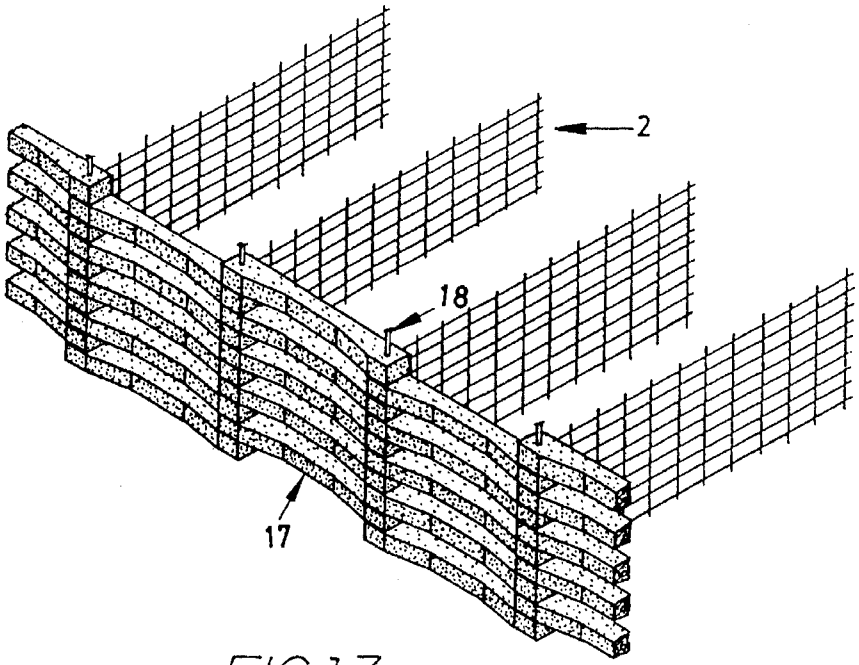
FIG. 13 is a perspective view similar to FIG. 1, but wherein the facing structure comprises elements made of prefabricated concrete which define an openwork structure.
Figure 14:
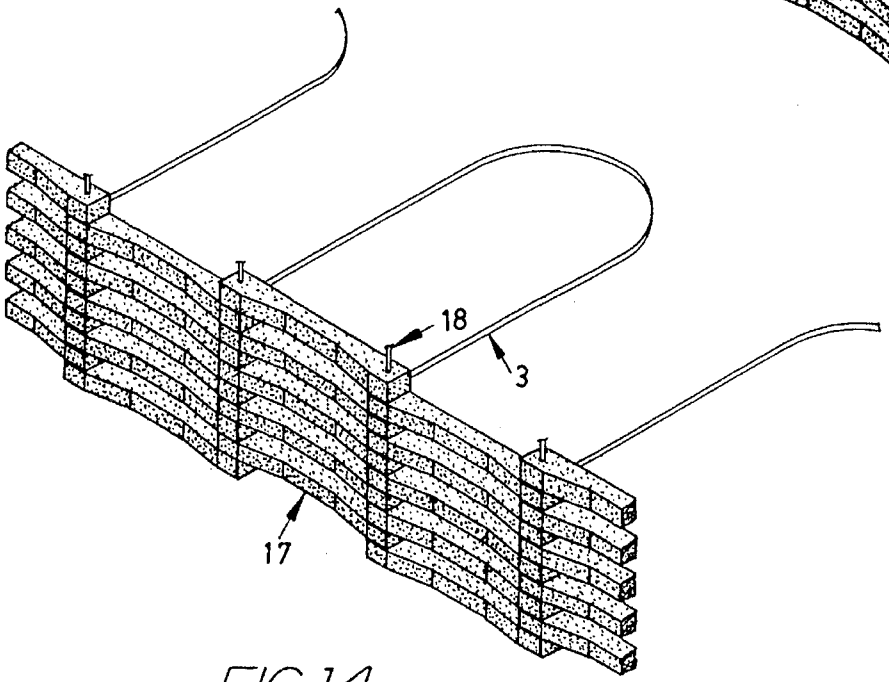
FIG. 14 is a perspective view similar to FIG. 2, but wherein the facing structure comprises elements made of prefabricated concrete which define an openwork structure.

FIGS. 13 and 14 illustrate cellular structures with embedding elements made of lattices 2 or stirrups 3 and which are characterized by prefabricated concrete facing elements 17 mounted as an openwork. The facing element can also be formed of wood beams.

The assembly elements are bars or pipes 18. Post-tensioned or not, these elements 18 allow also for the positioning of post-tension cables and also for the realization of injections. In the overlapping zone of the prefabricated concrete elements 17, that is at their extremities, one or more assembly elements 18 can be provided.

This type of cellular structure can be filled with stone of appropriate size or with soil. In the latter case, the openings in the façade are blocked off by metal sheet, asbestos-cement, geotextile, etc.

One of the particularities of this structure lies in the fact that it allows for vegetation to grow through the façade while retaining a large stability.

However, the spaces between the prefabricated elements 17, on the side of the soil, can be partially or totally blocked in order to allow or not the growth of the vegetation. This obturation is generally accomplished with blocks made of architectural concrete.

The parallelepiped-shaped prefabricated concrete element 17 is characterized in that its dimensions in its transversal cross-section are small with respect to its length. The opposite faces can be parallel or not. These elements are designed in order to absorb the thrust of the ground, to be assembled to the lattice or stirrup embedding elements 2 or 3 and to produce columns along their overlapping zone.

It is noted that as a result of the columns, this type of facing structure can be executed on limited heights with no embedding structures. In the overlapping zone, many elements or assembly bars 18, post-stressed or not, can then be used.

Figure 29:
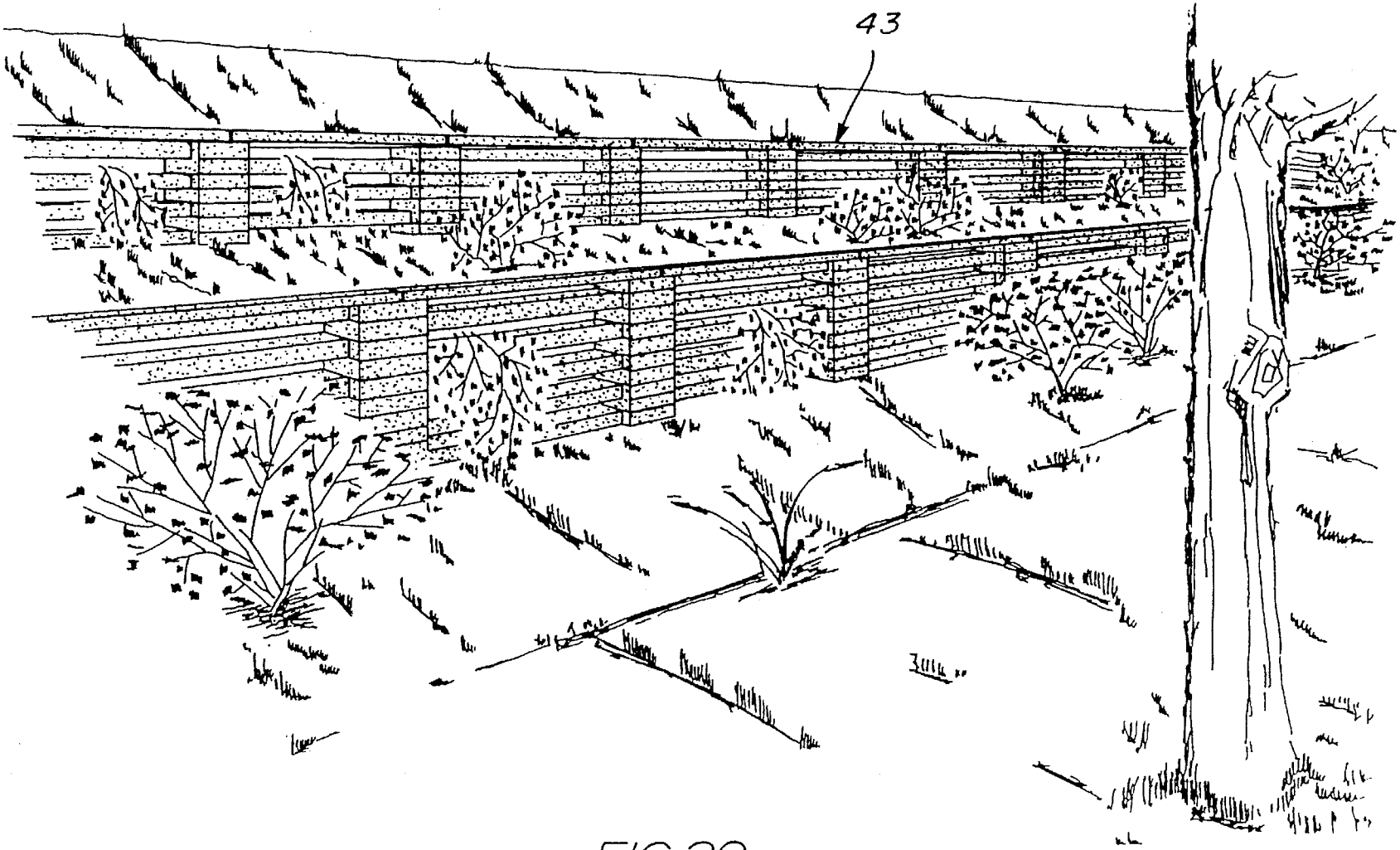
FIG. 29 is a perspective view of a sustaining wall using the openwork cellular structures of FIGS. 13 or 14.

FIG. 29 illustrates the use of cellular structures having openwork facing elements as described hereinabove for the production of sustaining walls 43. In this case, the openworks have not been blocked in order to allow for vegetation to grow through the façade of the sustaining walls 43.

Figure 30:
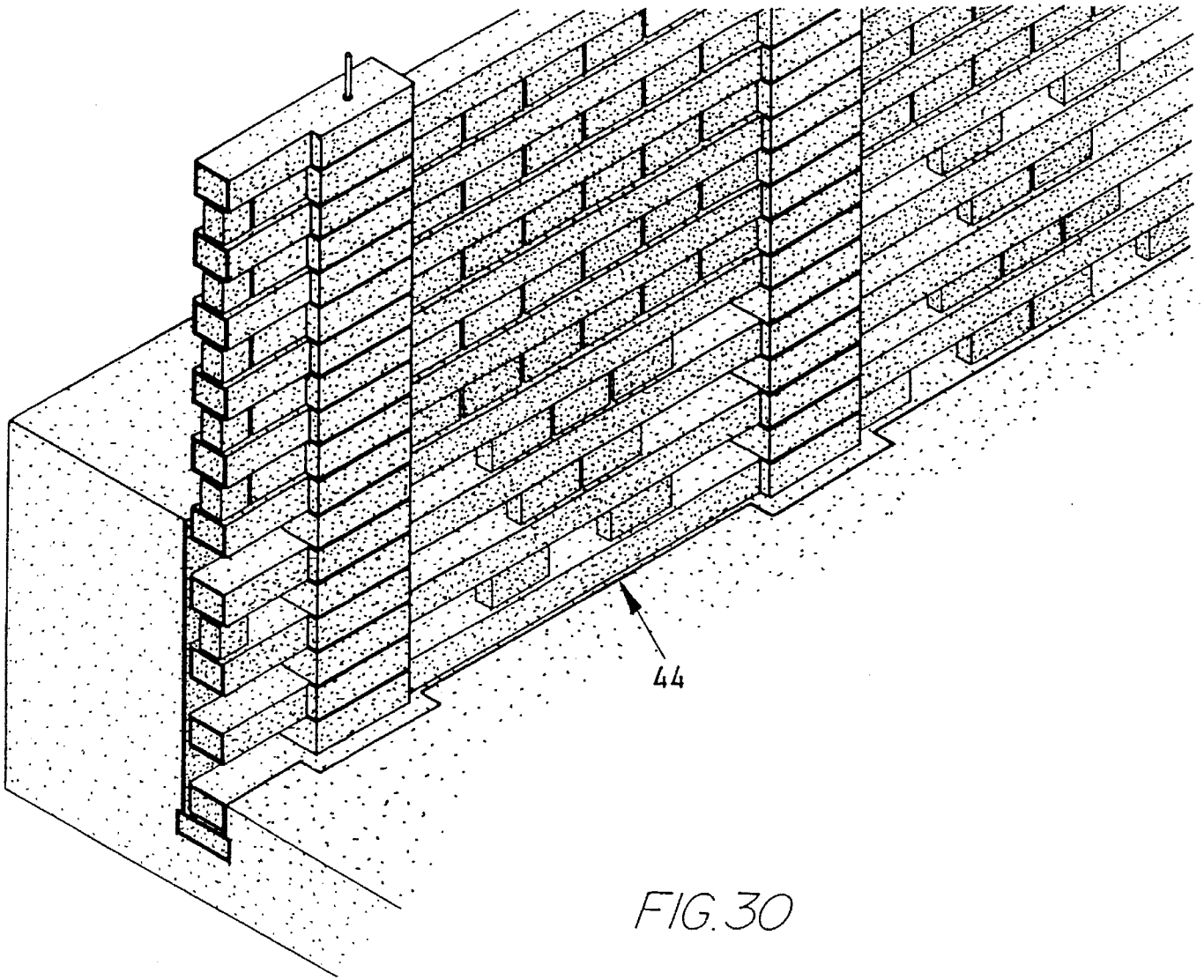
FIG. 30 is a perspective view of a sustaining and elevation wall using the openwork cellular structures of FIGS. 13 and 14.

FIG. 30 illustrates a wall 44 which is a sustaining wall in its lower section and an elevation wall in its upper section on both sides. The elevation wall is used principally as a soundproof wall; that is why all of its openworks have been obturated.

With openwork cellular structures, we can realize sustaining walls of all types, with or without vegetation, abutment-peers for bridges, walls for the head of culverts and even culverts, elevation walls, soundproof walls, etc.

Figure 15:
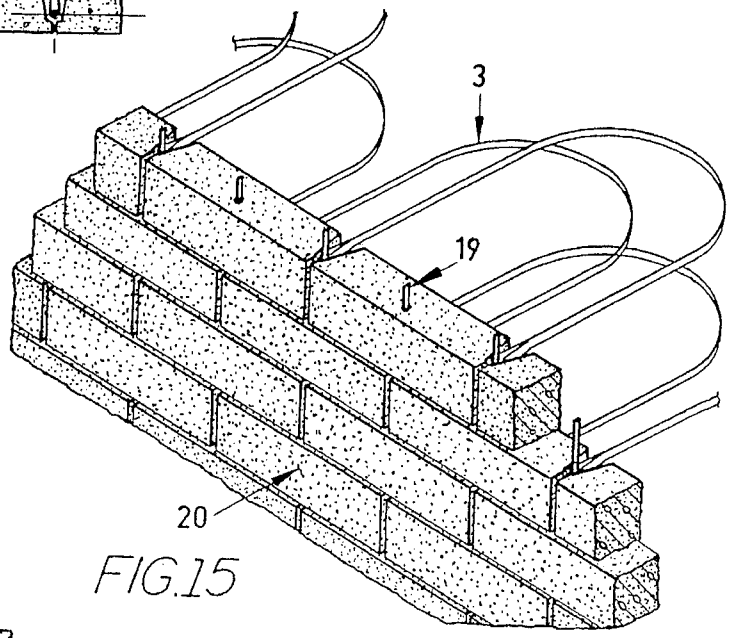
FIG. 15 is a perspective view similar to FIG. 2, but wherein the facing structure comprises blocks made of architectural concrete.
Figure 16:
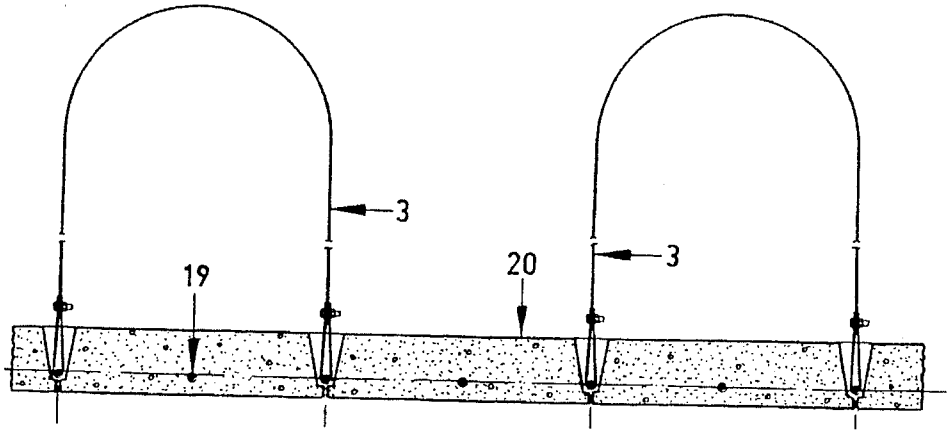
FIG. 16 is a top plan view of the structure of FIG. 15.
Figure 17:
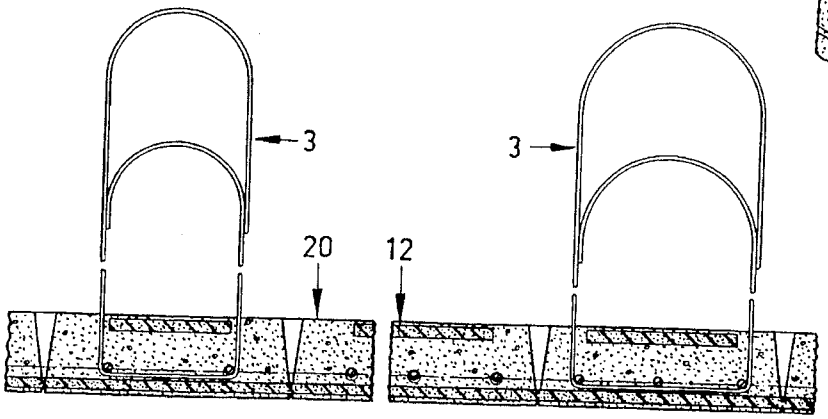
FIG. 17 is a horizontal cross-section illustrating a variant of the structure shown in FIGS. 15 and 16.
Figure 18:
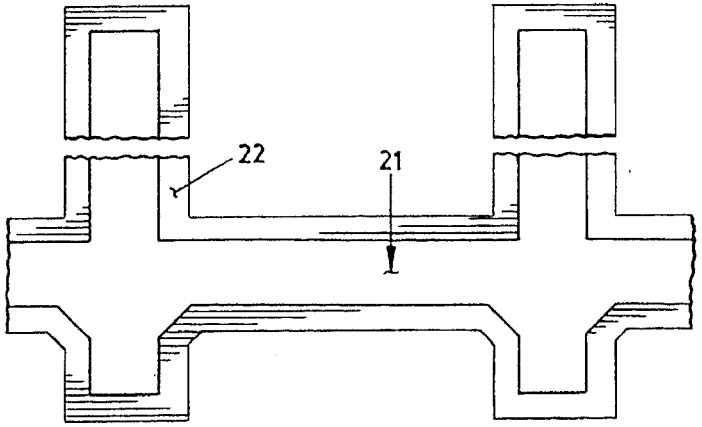
FIG. 18 is a top plan view illustrating the mud trench used to set a rigid cellular structure.
Figure 19:
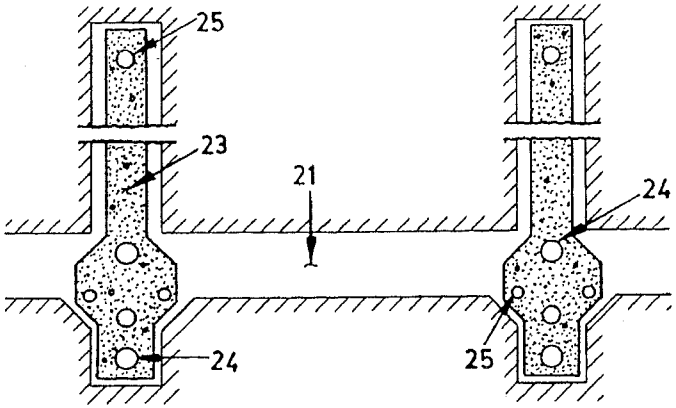
FIG. 19 is a top plan view illustrating the foundation elements of the rigid cellular structure.

FIGS. 15 to 17 illustrate cellular structures with facing elements made of small or medium size concrete panels. The same principles of cellular structures described hereinabove are complied with. FIG. 15 illustrates a cellular structure with an embedding structure made of stirrups 3, even though lattice embedding structures can also be used, and small or medium size architectural concrete blocks 20. The architectural concrete blocks 20 or the blocks made of cut stone are masoned using vertical rods or joggles 19. These rods 19 provide on one hand resistance and on the other hand a connection between the facing element and the embedding elements.

The stirrup embedding elements 3 are positioned in the vertical joints (FIG. 16) or in the horizontal joints (FIG. 17).

The stirrup embedding elements are built with metallic or synthetic flat bars (FIG. 16) or with round or square bars (FIG. 17). In the case of FIG. 17, wherein the embedding elements 3 are positioned in the horizontal joints, Neoprene type joints 12, similar to those of the integrated revetment cellular structures (FIG. 7) are anticipated.

The structures described hereinafter are sustaining walls made of large size prefabricated reinforced concrete elements assembled by post-tension in a mud trench or in water, in order to construct a rigid cellular structure having the shape of a U (FIGS. 18 to 25) which uses the same theoretical principles as those of the structures described hereinabove.

The prefabricated elements are heavy elements which are plant-manufactured and then carried and positioned in the liquid medium by way of appropriate machines.

The assembly elements, represented generally by pipes which are perforated or not, are used as guides for the installation and finally can be tensioned directly or by way of ties anchored in the foundation. These same pipes can be used for the injection of mortar.

Once the prefabricated elements have been assembled by post-tension, the structure will be completed with concrete poured on site.

The rigid cellular structures are constituted of facing structures which recover the stresses due to the thrust of the ground and of the water. The embedding structures are elements which recover the stresses of the facing structures and of other structures for transmitting them to the foundation. The assemblies are appropriately dimensioned pipes which are perforated or not and which have the multiple functions described hereinbelow. The concrete poured on site serves on one hand as the foundation and on the other hand it completes the structure.

These structures can be designed to be, or not, in close interdependence with the soil mass to support. In order to mount these rigid cellular structures, a trench of bentonite mud (FIG. 18) is previously built with guide low walls 22, in accordance with known and proven methods.

The foundation elements 23 which are then set (FIG. 19) comprise holes 24 provided for pouring the concrete under the foundation elements 23. The foundation elements 23 constitute an integral part of the embedding structures and are positioned at appropriate depth on a layer of concrete.

The pouring of the foundation concrete can precede the positioning of the prefabricated elements wherein the concrete can be poured through the holes 24 intended for this operation.

Pipes 25 fixed to the foundation elements 23 are used for guiding the prefabricated elements and then the pipes are used for the post-tension and for the injection.

Figure 20:
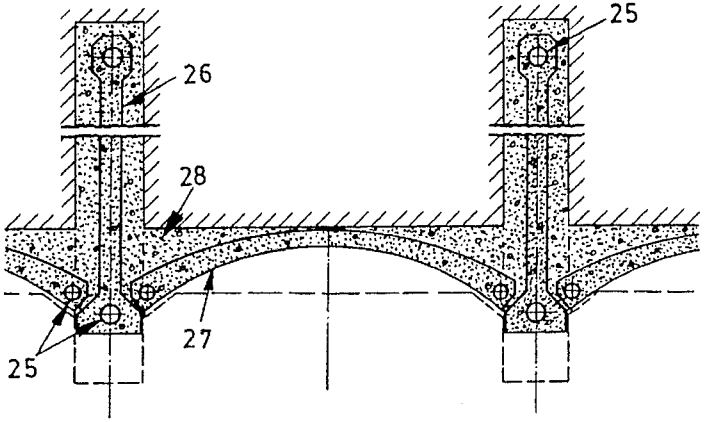
FIG. 20 is a top plan view illustrating a rigid cellular structure adapted to the foundation elements of FIG. 19.

The first embedding elements 26 are lowered along guiding elements 24 until their final position. Then, follows the positioning of the facing elements 27 (FIG. 20). The concrete 28 is then poured on site.

The operation of alternately mounting the embedding elements and the facing elements is continued until the final shore.

Once the prefabricated elements have been set, the operations of post-tensioning and the filling of the pipes with mortar are carried out.

Neoprene strips can be provided to improve the sealing of the structure and also to ensure a better contact between the horizontal joints.

As a last phase, the fresh concrete will be poured between the prefabricated elements and the soil, thereby completing the structure.

FIGS. 18 to 21 illustrate an underframe of a pier. It consists of rigid cellular structures containing soil. The interdependence between the structure and the ground is clearly revealed. This type of structure can be used for piers of all types, be they constructed by way of a mud trench (FIG. 18), or directly in water.

Figure 21:
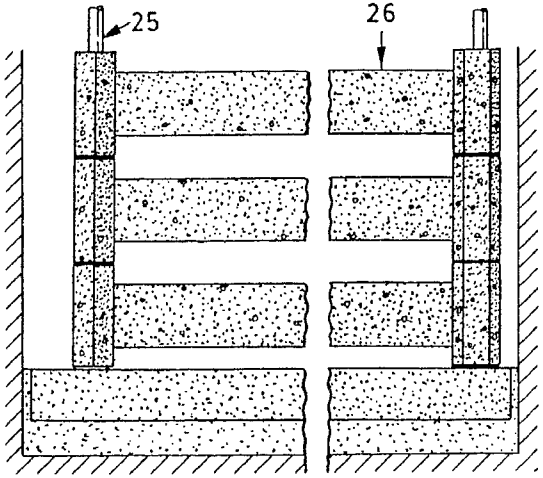
FIG. 21 is an elevation view based on FIG. 20.

The facing elements are continuous in the vertical direction whereas the embedding elements can be hollowed out in order to lighten the prefabricated elements and in order to obtain a better monolithism with the concrete poured on site or with the embankment (FIG. 21). The embedding elements can be constructed with ironwork elements or with concrete elements poured on site.

FIGS. 22 to 25 illustrate an underframe of a building. The erection steps are similar to those found in FIGS. 18 to 21. In this case, it consists of rigid cellular structures with cleared away embedding elements. This structure will be used mainly for the construction of buildings having multiple basements.

Figure 24:
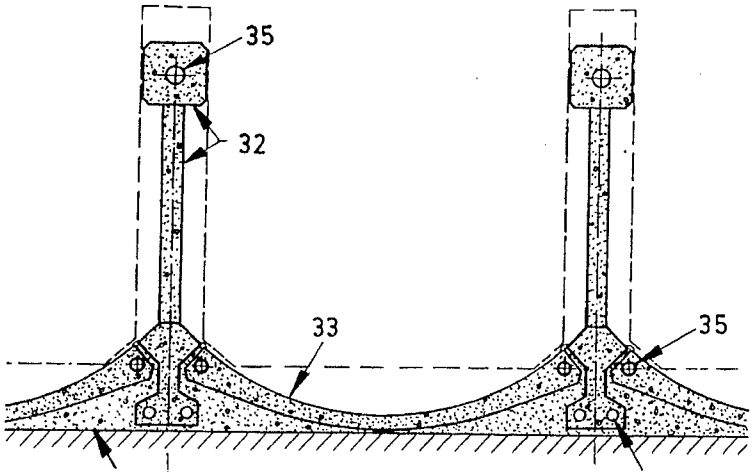
FIG. 24 is a top plan view of the rigid cellular structure adapted to the foundation elements of FIG. 23.

The construction is identical to the preceding case, but the structural behavior is different. There is no interaction between the ground and the structure since the embedding elements will remain free inside the building which is an integral part of its structure. In this case, the embedding elements become buttresses (FIG. 24).

Figure 25:
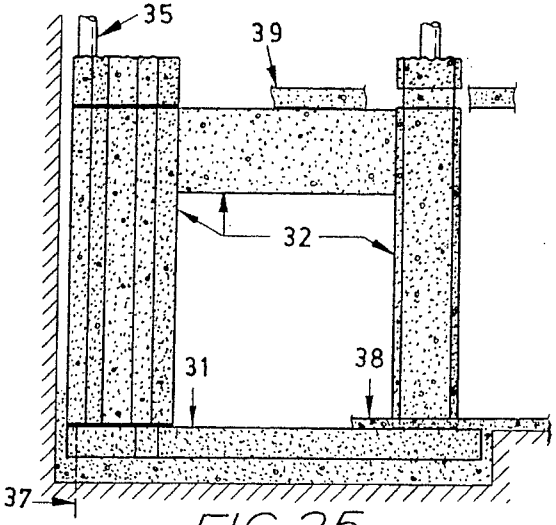
FIG. 25 is an elevation view of the embedding elements of the rigid cellular structure of FIG. 24 along the height of one storey.

The prefabricated facing and buttress elements can have a height equal to the distance between the floors (FIGS. 25).

Once the sustaining structure has been assembled and the concrete poured on place has sufficiently hardened, the excavation works can begin. The perpendicular underpinning on the buttresses can be felt in the case of large depths.

The extremities of the buttresses can be seatings for the columns of the building's superstructure. The buttress elements can be more or less hollowed out, according to their degree of stress (FIG. 25).

The floors which are built represent a good horizontal wind-brace, which results in an increase in the stability.

If necessary for the overall stability, anchoring ties are installed inside the assembly pipes (FIG. 25).

Figure 22:
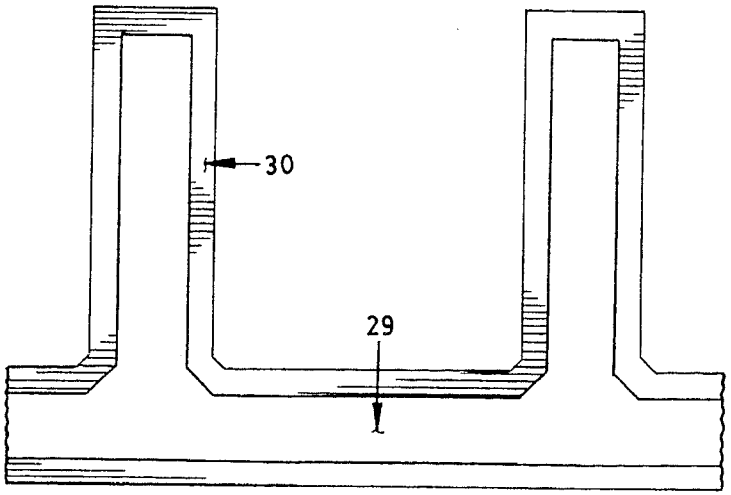
FIG. 22 is a top plan view of a mud trench adapted for a rigid cellular structure for basements of buildings.

More particularly, FIG. 22 illustrates a mud trench 29 having guide low walls 30 which are designed for positioning the rigid cellular structure intended for the basements of the buildings.

Figure 23:
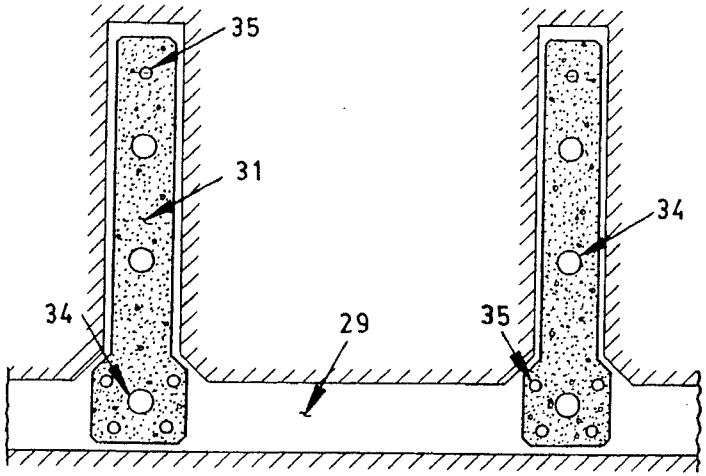
FIG. 23 is a top plan view illustrating the foundation elements of the rigid cellular structure.

FIG. 23 illustrates the setting of foundation elements 31 which comprise holes 34 with a view of pouring concrete under the foundations. Guide pipes 35 are fixed on the foundation elements 31.

In FIG. 24, the cleared away rigid veil structure is illustrated with its embedding elements 32 and its facing elements 33. Between the structure and the soil, there is the filling concrete 36.

FIG. 25 is an elevation view of the embedding elements 32 along the height of one storey. There is found the floor bed 38 and the structure 39 of one storey. As an option, post-tension ties 37 are disposed inside the guiding pipes 35.

The rigid cellular structures can be constructed perfectly tight. One very important advantage for the use of this type of structure lies in the total absence of anchoring ties outside of the periphery of the construction, which is what is found in conventional walls built in a mud trench.

Figure 26:
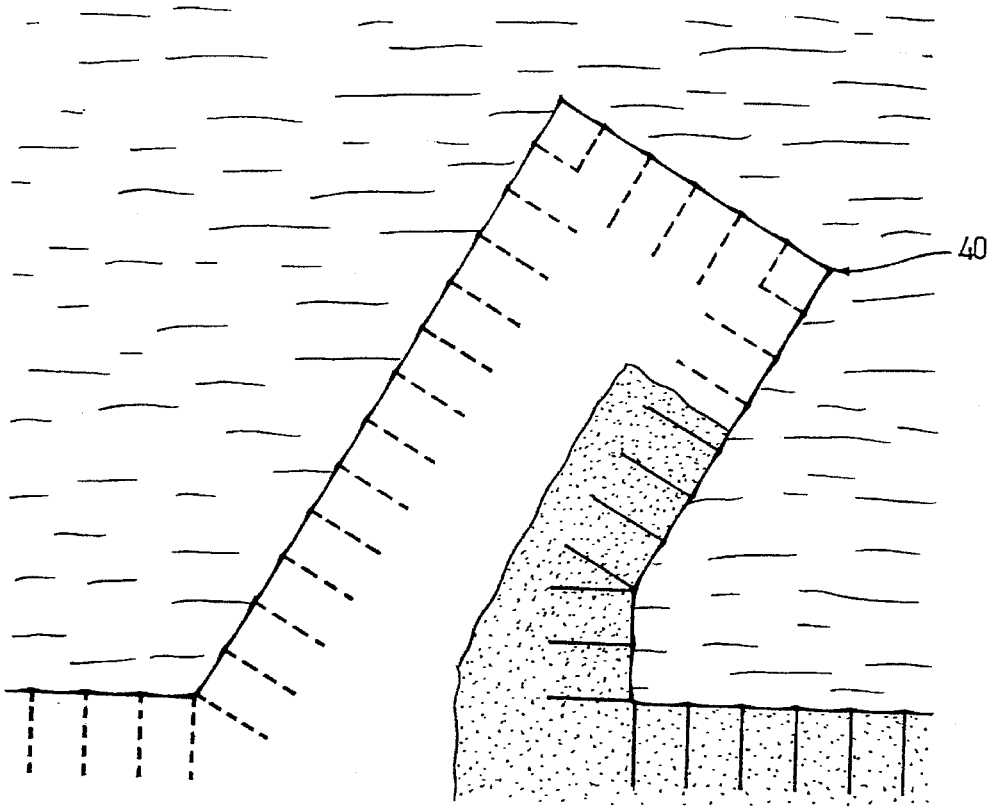
FIG. 26 is a partly fragmented top plan view illustrating the application of rigid cellular structures for a deep water pier.
Figure 27A:
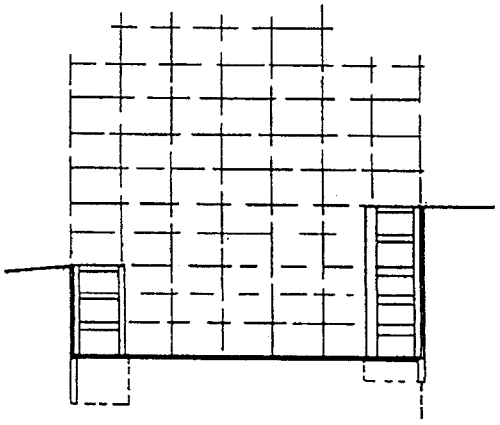
FIGS. 27 and 27*a* are views illustrating the application of rigid cellular structures for the sub-structure of a building.
Figure 27:
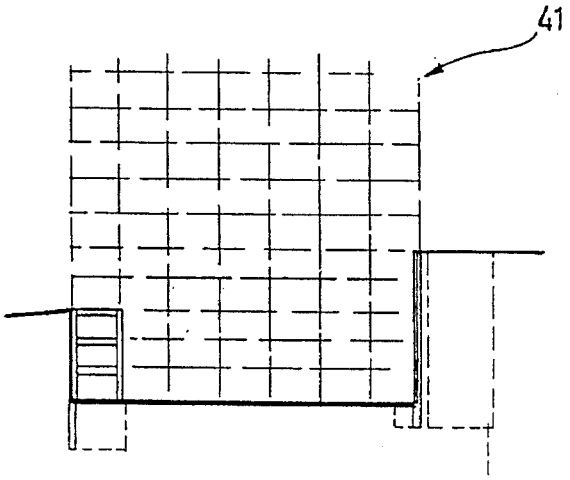
Figure 28:
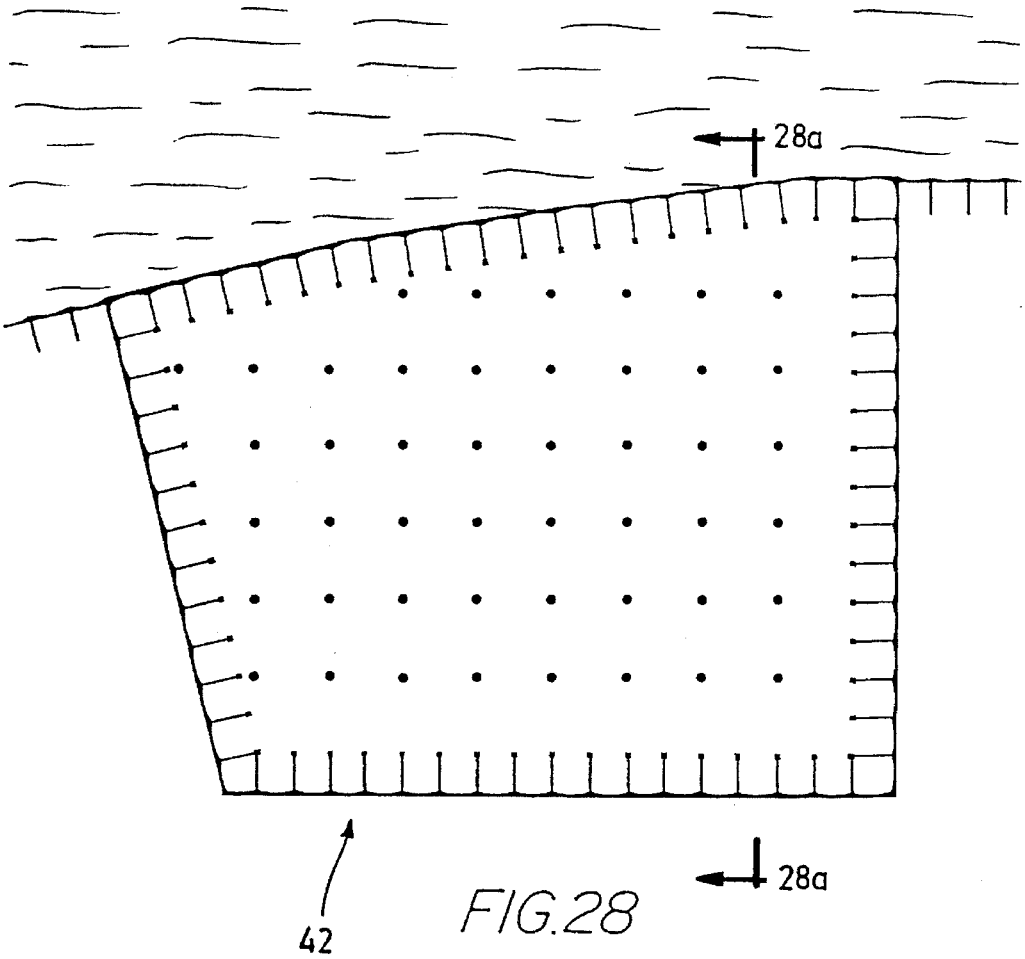
FIG. 28 is a top plan view and FIG. 28*a* is a vertical cross-section taken along lines 28*a*—28*a* of FIG. 28 illustrating the sub-structure of a large building located on a shore.
Figure 28A:
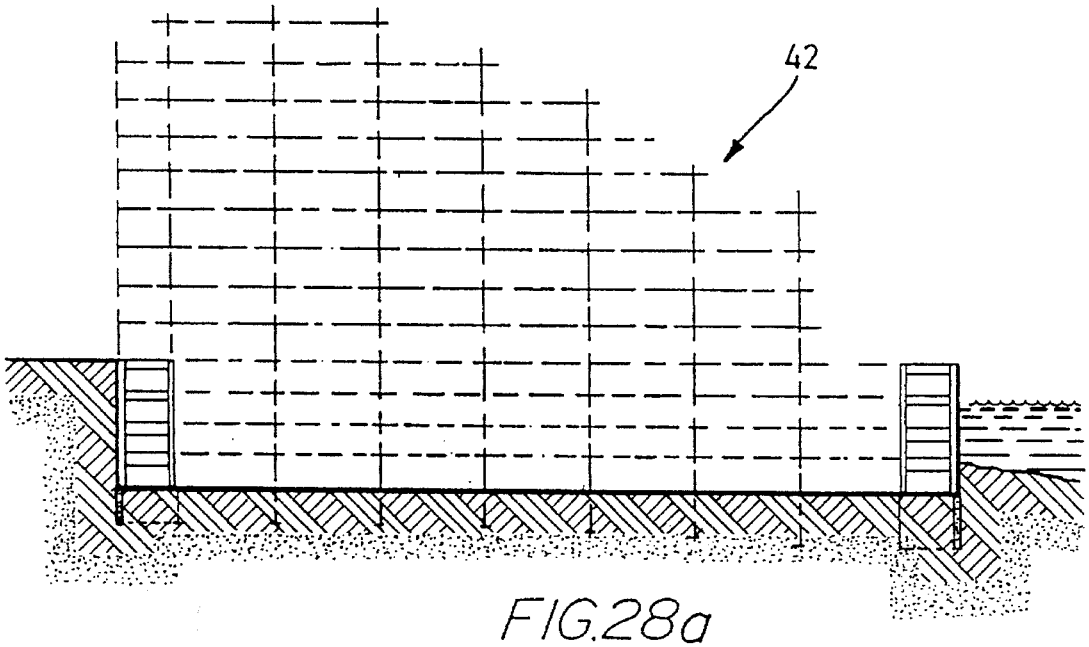

A few practical examples of rigid veil cellular structures are illustrated in FIGS. 26 to 28. FIG. 26 illustrates a deep water pier 40 which uses a plurality of rigid cellular structures as described in FIGS. 18 to 21. FIGS. 27 and **27*a* illustrate a building infrastructure 41 which uses the cellular structures of FIGS. 22 to 25. FIGS. 28 and 28*a* illustrate the infrastructure of a large size building 42** (the basements) located on the shore. In this case, the rigid cellular structure is stressed by the soil or by the water.

One of the main advantages of the use of cellular structures having lattice facing elements and lattice or stirrup embedding elements and also of the other cellular structures described hereinabove lies in the fact that the materials necessary for their erection are available on the market.

These structures are very simple on one hand by the manufacture of the structural elements and on another hand by their implementation. They can accommodate many types of façades, whereby the desired aesthetic can be given to the sustaining wall so erected. Under their different forms, these cellular structures have various applications.

I claim:

1. A cellular structure for sustaining an embankment substantially in the shape of a U, comprising a facing element adapted to extend at an angle with respect to a horizontal plane, a pair of embedding lattice elements adapted to extend at an angle with respect to a horizontal plane, each embedding element being adapted to extend substantially from a respective lateral edge of said facing element towards the embankment, said facing element being adapted for defining a façade of said cellular structure, said embedding elements, when installed, extending separately from one another in the embankment from said facing element with no structure except for the embankment itself interconnecting said embedding elements rearwards of said facing element, whereby said cellular structure is open towards the embankment.

2. A cellular structure according to claim 1 wherein said facing element comprises a substantially vertical lattice, and wherein said embedding lattice elements are also substantially vertical.

3. A cellular structure according to claim 2 wherein said facing and embedding elements are each constituted of a metallic or synthetic lattice.

4. A cellular structure according to claim 2 wherein at least one of a sunk framework and a façade of cast concrete are provided respectively behind and in front of said facing element.

5. A cellular structure according to claim 2 wherein a sunk framework and a masonry façade of concrete blocks or cut stone are provided respectively behind and in front of said cellular structure, said masonry façade being reinforced and joined to said facing element, a space between the facing element and the masonry façade being adapted for being filled with concrete.

6. A cellular structure according to claim 2 wherein vertical rods are used for connecting the embedding elements to the lateral edges of the facing elements.

7. A cellular structure for sustaining an embankment comprising a facing element adapted to extend at an angle with respect to a horizontal plane, an embedding element formed of at least one stirrup, said stirrup being adapted for connecting each of the two extremities thereof substantially to a respective lateral edge of said facing element, said stirrup having substantially a U shape adapted to extend in the embankment so as to be anchored rearwards of said facing element only by the embankment itself, said facing element defining a façade of said cellular structure.

8. A cellular structure according to claim 7 wherein said embedding element is constituted of at least two stirrups depending on the height of the cellular structure, said facing element comprising a substantially vertical lattice, said stirrups being mounted to said facing element in a spaced apart way along a vertical plane and extending in the embankment in a substantially horizontal and parallel way.

9. A cellular structure according to claim 8 wherein said embedding element is constituted of metallic or synthetic stirrups.

10. A cellular structure according to claim 8 wherein said stirrups are flat strips or round or square bars.

11. A cellular structure according to claim 8 wherein said facing element is a metallic or synthetic lattice.

12. A cellular structure according to claim 8 wherein at least one of a sunk framework and a façade of cast concrete are provided respectively behind and in front of said facing element.

13. A cellular structure according to claim 8 wherein a sunk framework and a masonry façade of concrete blocks or cut stone are provided respectively behind and in front of said cellular structure, said masonry façade being reinforced and joined to said facing element, a space between the facing element and the masonry façade being adapted for being filled with concrete.

14. A cellular structure according to claim 8 wherein vertical rods are used for connecting the embedding elements to the lateral edges of the facing elements.

15. A sustaining wall comprising many similar cellular structures each including a facing element extending at an angle with respect to the horizontal and including substantially at each lateral edge thereof an embedding lattice element extending at an angle with respect to the horizontal, each cellular structure containing an embankment, the embedding elements of a same cellular structure extending separately from one another from said facing element in the embankment with no structure except for the embankment itself interconnecting said embedding elements of said same cellular structure rearwards of said facing element, whereby said cellular structure is open towards the embankment, embedding elements of adjacent cellular structures being applied one against another.

16. A sustaining wall according to claim 15 wherein for each cellular structure, said facing element comprises a substantially vertical lattice, and wherein said embedding elements extend substantially vertically and are integral to said facing element.

17. A sustaining wall comprising many similar cellular structures each including a facing element extending at an angle with respect to the horizontal and including substantially at each lateral edge thereof an embedding lattice element which extends at an angle with respect to the horizontal and which is common to an adjacent cellular structure, each cellular structure containing an embankment, the embedding elements of a same cellular structure extending separately from one another from said facing element in the embankment with no structure except for the embankment itself interconnecting said embedding elements of said same cellular structure rearwards of said facing element, whereby said cellular structure is open towards the embankment.

18. A sustaining well comprising many similar cellular structures each including a facing element extending at an angle with respect to the horizontal and an embedding element formed at least of one stirrup joined at each of two extremities thereof substantially to a respective lateral edge of said facing element, each stirrup having the shape of a U extending in an embankment contained in a respective cellular structure so as to be anchored rearwards of said facing element only by the embankment itself.

19. A method for erecting a sustaining wall comprising the following steps:

a) positioning many similar cellular structures each including a facing element extending at an angle with respect to the horizontal and including substantially at each lateral edge thereof an embedding lattice element extending at an angle with respect to the horizontal in such a way that the embedding elements of a same cellular structure extend separately from one another rearwardly from the facing element, said cellular structures being positioned in such a way that each embedding element is applied against an embedding element of an adjacent similar cellular structure; and b) filling each of said cellular structures with an embankment, said embedding elements being anchored by the embankment, wherein, rearwards of said facing element, no structure except for the embankment itself interconnects the embedding elements of said same cellular structure, whereby each said cellular structure is open towards the embankment.

20. A method for erecting a sustaining wall comprising the following steps:

a) positioning in a spaced apart and generally parallel way many embedding lattice elements extending at an angle with respect to the horizontal and in a way substantially perpendicular to the façade of said sustaining wall;

b) connecting each front lateral edge of each adjacent pair of embedding elements to a respective lateral edge of a facing element extending at an angle with respect to the horizontal in such a way that said embedding elements of a same cellular structure extend separately from one another rearwardly from said facing element; and c) filling with an embankment each of the cellular structures defined by each adjacent pair of embedding element and by the facing element connected therebetween, said embedding elements being anchored by the embankment, wherein, rearwards of said facing element, no structure except for the embankment itself interconnects the embedding elements of said same cellular structure, whereby each said cellular structure is open towards the embankment.

21. A method for erecting a sustaining well comprising the following steps:

a) positioning many similar cellular structures each including a facing element extending at an angle with respect to the horizontal and an embedding element formed at least of one stirrup connected at each of two extremities thereof to a respective lateral edge of said facing element in order to form a U extending opposite said facing element; and b) filling each of said cellular structures with an embankment, said embedding elements being anchored by the embankment.

22. A cellular structure for sustaining an embankment in the shape of a U open towards the embankment comprising a facing structure adapted to extend at an angle with respect to a horizontal plane, a pair of embedding lattice elements adapted to extend at an angle with respect to a horizontal plane, said facing structure comprising many elongated elements made of prefabricated concrete adapted to be horizontally mounted as an openwork on a non horizontal plane, said elongated elements being adapted to overlap at extremities thereof with similar elongated elements of adjacent cellular structures, said embedding elements being adapted to be mounted to respective extremities of the facing structure, said facing structure being adapted to define a façade of said cellular structure, and said embedding elements, when installed, being adapted to extend separately from one another in the embankment from the extremities of the facing structure with no structure except for the embankment itself interconnecting said embedding elements rearwards of said facing structure, whereby said cellular structure is open towards the embankment.

23. A cellular structure according to claim 22 wherein a geotextile is adapted to be positioned in a substantially vertical way between the facing structure and the embankment in order to allow a soil embankment and to allow vegetation to extend through said facing structure at openings defined between said prefabricated concrete elements.

24. A cellular structure according to claim 22 wherein architectural concrete elements are adapted to be positioned in openings defined between said prefabricated concrete elements.

25. A cellular structure according to claim 22 wherein the facing structure comprises vertical rods for maintaining in position and adjusting the overlapping elongated elements of two adjacent cellular structures, the extremities of said elongated elements being adapted in order that the vertical rods extend therethrough.

26. A cellular structure for sustaining an embankment comprising a facing structure adapted to extend at an angle with respect to a horizontal plane, an embedding element formed of at least one stirrup, said facing structure comprising many elongated elements made of prefabricated concrete adapted to be horizontally mounted as an openwork on a non horizontal plane, said elongated elements being adapted to overlap at extremities thereof with similar elongated elements of adjacent cellular structures, each stirrup being adapted for connecting each of two extremities thereof to a respective extremity of the facing structure, said facing structure being adapted to define a façade of said cellular structure, and each stirrup having the shape of a U adapted to extend in the embankment from the extremities of the facing structure so as to be anchored rearwards of said facing structure only by the embankment itself.

27. A cellular structure according to claim 26 wherein the facing structure comprises vertical rods for maintaining in position and adjusting the overlapping elongated elements of two adjacent cellular structures, the extremities of said elongated elements being adapted in order that the vertical rods extend therethrough.

28. A cellular structure according to claim 26 wherein a geotextile is adapted to be positioned in a substantially vertical way between the facing structure and the embankment in order to allow a soil embankment and to allow vegetation to extend through said facing structure at openings defined between said prefabricated concrete elements.

29. A cellular structure according to claim 26 wherein architectural concrete elements are adapted to be positioned in openings defined between said prefabricated concrete elements.

30. A sustaining wall comprising many similar cellular structures each including a facing structure which extends at an angle with respect to a horizontal plane and which is connected to two embedding lattice elements which extend at an angle with respect to a horizontal plane and which are common to adjacent cellular structures, the facing structures being each formed of many elongated elements made of prefabricated concrete horizontally mounted as an openwork on a non horizontal plane, said elongated elements overlapping at extremities thereof with similar elongated elements of adjacent facing structures, the embedding elements being connected to respective extremities of respective facing structures, each cellular structure containing an embankment, and the embedding elements of a same cellular structure extending separately from one another from a respective facing structure in a respective embankment with no structure except for the embankment itself interconnecting said embedding elements of said same cellular structure rearwards of said facing structure, whereby each said cellular structure is open towards the embankment.

31. A sustaining wall according to claim 30 wherein each facing structure comprises vertical rods which extend through the extremities of the overlapping elongated elements of two adjacent cellular structures to maintain them in position.

32. A sustaining well according to claim 31 wherein said facing structures and the rods extend vertically above said embedding elements in order to form an elevation wall, openings defined between the prefabricated concrete elements of said elevation wall being closed by elements made of architectural concrete.

33. A sustaining wall comprising many similar cellular structures each including a facing structure which extends at an angle with respect to a horizontal plane and which is connected to an embedding element formed of at least one stirrup, said facing structures each being formed of many elongated elements made of prefabricated concrete horizontally mounted as an openwork on a non horizontal plane, said elongated elements overlapping at extremities thereof with similar elongated elements of adjacent facing structures, each stirrup having the shape of a U and being connected at each of two extremities thereof to a respective extremity of a respective facing structure, each cellular structure containing an embankment, and each embedding element extending from a respective facing structure in the embankment of a respective cellular structure so as to be anchored rearwards of said facing structure only by the embankment itself.

34. A sustaining wall according to claim 33 wherein each facing structure comprises vertical rods which extend through the extremities of the overlapping elongated elements of two adjacent cellular structures to maintain them in position.

35. A sustaining wall according to claim 34 wherein said facing structures and the rods extend vertically above said embedding elements in order to form an elevation wall, openings defined between the prefabricated concrete elements of said elevation wall being closed by elements made of architectural concrete.

* * * * *